US008763539B2

(12) United States Patent
Odar Pena et al.

(10) Patent No.: US 8,763,539 B2
(45) Date of Patent: Jul. 1, 2014

(54) KIT FOR THE MODULAR ASSEMBLY OF A PIECE OF FURNITURE IN SITU

(76) Inventors: Ymelda Maribel Odar Pena, Lima (PE); Alejandro Fabian Marcovich, Buenos Aires (AR)

( * ) Notice: Subject to any disclaimer, the term of this patent is extended or adjusted under 35 U.S.C. 154(b) by 432 days.

(21) Appl. No.: 12/998,623

(22) PCT Filed: Nov. 10, 2009

(86) PCT No.: PCT/IB2009/007635

§ 371 (c)(1),
(2), (4) Date: Aug. 6, 2011

(87) PCT Pub. No.: WO2010/055417

PCT Pub. Date: May 20, 2010

(65) Prior Publication Data

US 2012/0037782 A1 Feb. 16, 2012

(30) Foreign Application Priority Data

Nov. 11, 2008 (AR) ..... P080104923

(51) Int. Cl.
*A47B 13/00* (2006.01)

(52) U.S. Cl.
USPC ..... 108/157.18; 108/12; 108/157.16; 248/460

(58) Field of Classification Search
USPC ..... 248/558, 460, 150, 151, 152, 165, 174, 248/453, 153.1; 108/11, 12, 16, 150, 151, 108/152, 153.1, 157.1, 157.13, 157.16, 108/157.18; 446/106, 108–110, 122, 479, 446/482; 211/186, 187, 189, 190
See application file for complete search history.

(56) References Cited

U.S. PATENT DOCUMENTS

| | | | | | |
|---|---|---|---|---|---|
| 1,301,797 | A | * | 4/1919 | Ziegler | 211/24 |
| 4,188,067 | A | * | 2/1980 | Elmer | 297/440.13 |
| 4,205,818 | A | * | 6/1980 | Lawler | 248/460 |
| 5,156,096 | A | * | 10/1992 | Lamprey | 108/152 |
| 5,992,938 | A | * | 11/1999 | Jones | 297/440.13 |
| 2005/0046243 | A1 | | 3/2005 | Cimino et al. | |

* cited by examiner

*Primary Examiner* — Jeanette E Chapman
*Assistant Examiner* — Daniel Kenny
(74) *Attorney, Agent, or Firm* — Volpe and Koenig, P.C.

(57) ABSTRACT

A kit for modular assembly of a piece of furniture "in situ" that comprises lower, intermediate, and upper main support members. Each of the main support members includes insertion slots with chamfered edges that are oriented at different angles in the periphery. The lower main support member has first and second foot slots that include locking ends. A plurality of cantilevered members having open insertion slots with chamfered edges each have a front fit-in section and a rear insertion section that end in an insertion stop. The open insertion slots are disposed in the periphery of the cantilevered members so that they may engage the oriented insertion slots. The first and second foot members are configured to engage first and second foot slots. The main support members have mutual engagement means that include coupling members and fastening openings for structural assembly of a piece of furniture.

20 Claims, 13 Drawing Sheets

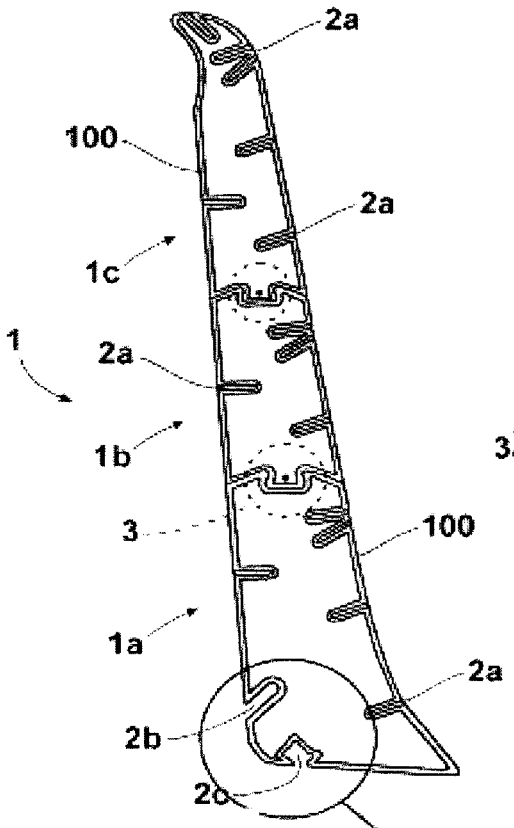
Fig. 1
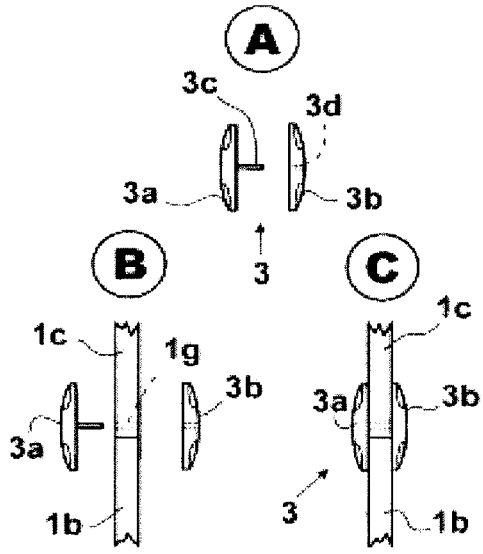
FIG. 1b
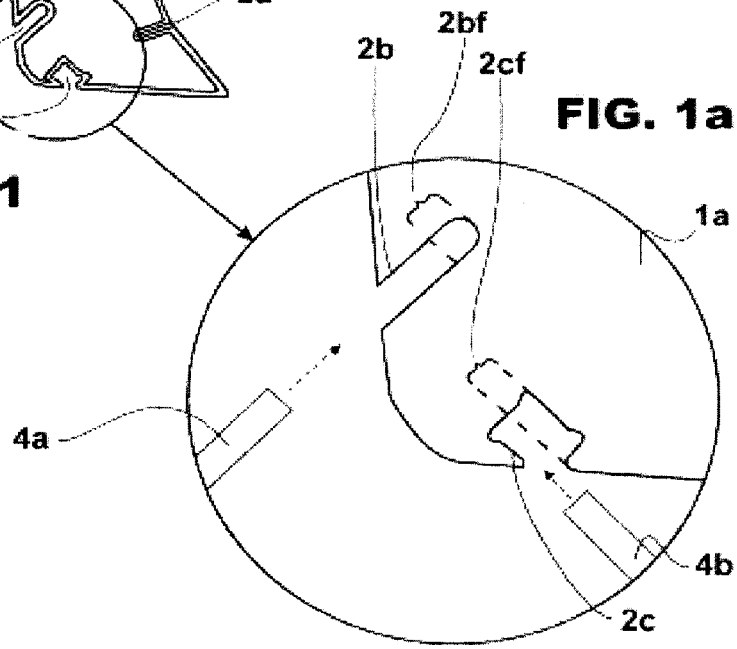
FIG. 1a
FIG. 1c
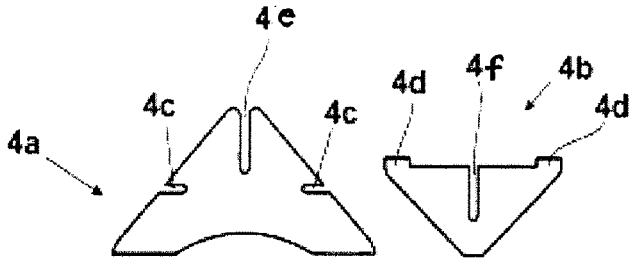

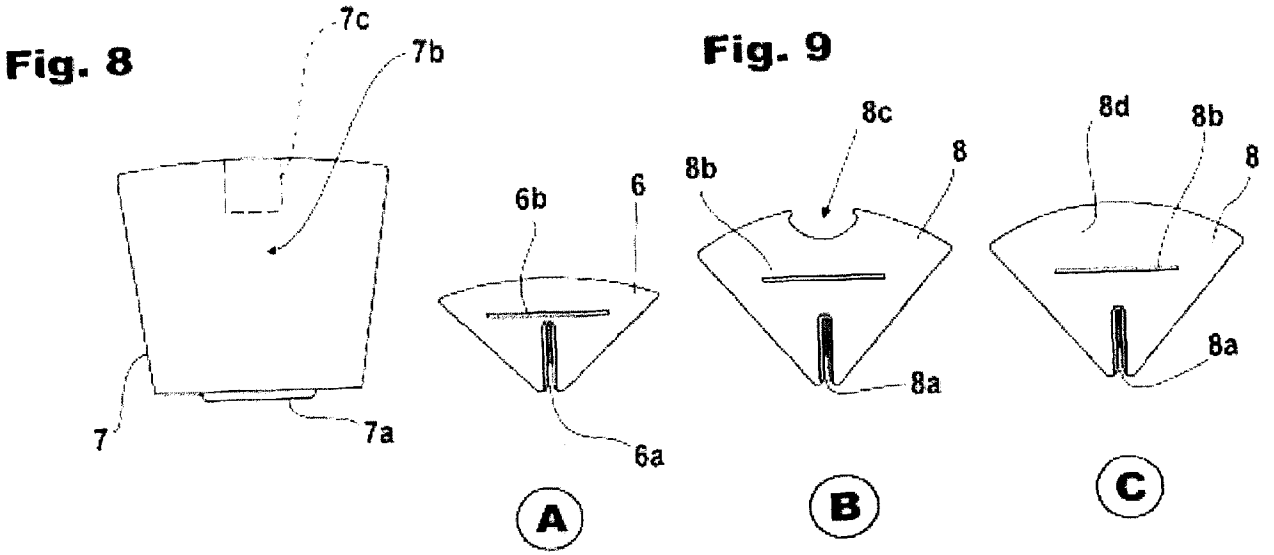
Fig. 8
Fig. 9
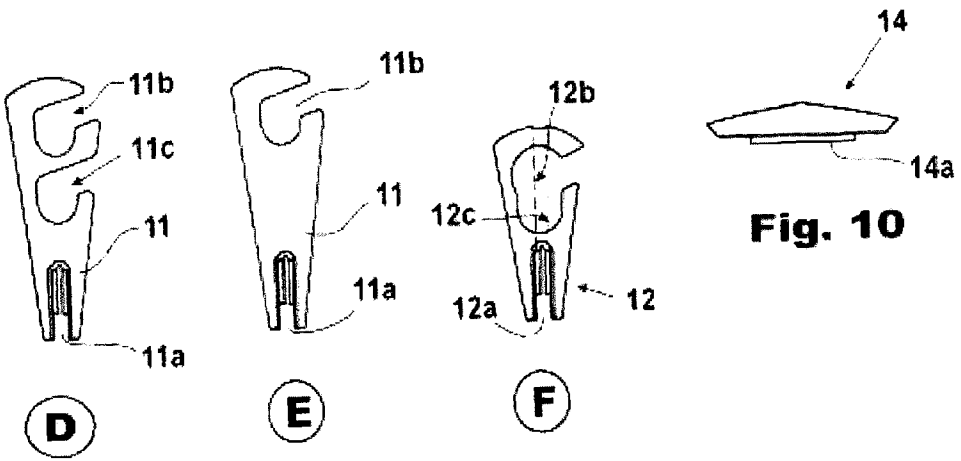
Fig. 10

KIT FOR THE MODULAR ASSEMBLY OF A PIECE OF FURNITURE IN SITU

CROSS REFERENCE TO RELATED APPLICATIONS

This application is a 371 national phase application of International Application No. PCT/IB2009/007635 filed Nov. 10, 2009, which claims priority to Argentina patent Application No. P-080104923 filed Nov. 11, 2008, the entire contents which are incorporated by reference as if fully set forth.

FIELD OF INVENTION

The present invention relates to a kit for the modular assembly and erection of a piece of furniture "in situ" using a combination of main support members, all or some of which are used in various arrangements. Specifically, the present invention relates to a kit for the modular assembly of a musical instrument stand "in situ".

BACKGROUND

There are many different types and kinds of musical instrument stands and support devices.

For example, U.S. Pat. No. 4,205,818 describes a stand that is adapted to support a musical instrument, such as a guitar, in an upright manner and is assembled or disassembled in a rapid and convenient manner. The stand includes a pair of spaced-apart, upright L-shaped members inclined toward one another. The members each include forwardly projecting, spaced-apart foot portions that support a bottom portion of the musical instrument. Strut members extend between the L-shaped members to secure them in place. A support device that is releasably attached to the upper portion of at least one of the L-shaped members supports the upper portion of the musical instrument. The support device is also adapted to support sheet music. A foot rest, configured to rotate between a horizontal use position for receiving and supporting the foot of a user and a generally vertical position, is provided to support the foot of a user during the playing of the musical instrument. In the horizontal use position, the foot rest supports the foot of the user. In the vertical position, the foot rest rotates behind the musical instrument so that it does not contact the musical instrument when it is resting on the stand.

U.S. Pat. No. 5,156,096 describes an anti-rotational outdoor shelf that has an unobstructed surface that abuts a natural surface and that is supported from below. The unobstructed surface has multi-dimensional stability that is provided by legs that are angled with respect to a central axis so that load forces are transformed into stabilizing forces and undesirable tipping, rotation, and revolution about a support member are avoided. A gap exists between the unobstructed surface and the natural support, e.g., a tree, so that a tight attachment between the outdoor shelf and the natural support is not needed and vertical sliding of the legs can occur. The design compacts when not temporarily installed through the slidable connections.

The devices disclosed in the foregoing-mentioned patents have been satisfactory for some applications, but it is desirable to have a musical instrument stand that can be assembled and disassembled quickly and readily transported in a knocked-down form. The musical instrument stand should be useful for different kinds of musical instruments such as guitars, saxophones or the like and should have the capability to support the musical instruments in a substantially vertical position when not in use. The musical instrument stand should also be configured to support sheet music while the user is playing the musical instrument and be adjustable to different heights depending on the position of the use. For example, the musical instrument stand should be adjustable to a sitting or standing position while the user is performing or be adjustable so that the stand may be used, alternatively, as a desk stand or table that has the capability to hold a can or glass. The musical instrument stand should be relatively inexpensive to manufacture and aesthetically pleasing in appearance.

SUMMARY

An object of the present invention is to provide a new and improved musical instrument stand that can be readily assembled and disassembled for transport in a knocked-down form.

Another object of the present invention is to provide a new and improved musical instrument stand that can be adapted to support varying types of musical instruments, sheet music, books, glasses, cans, or the like.

Briefly, the above and further objects of the present invention are realized by providing a kit that comprises one or more main support members with oriented insertion slots and at least one foot member. Each of the main members are equipped with multiple oriented insertion slots so that a structure of varying angles and heights may be assembled by means of coupling members and securing clamps. The kit may also include a main bearing member and cantilevered members that engage with the oriented insertion slots of the main members.

The kit includes upper, intermediate, and lower main support members that allow for the assemblage of pieces of furniture that vary in height. In one embodiment, the lower main support member is combined with a support base and the main bearing member to assemble a low lectern or desk. In another embodiment, the lower main support member is combined with the intermediate main support member to assemble a lectern of intermediate height for seating a user. In another embodiment, the lower main support member, intermediate main support member, and the upper main support member are combined to assemble a lectern for standing users. In another embodiment, the kit is assembled as a table and the same height options are obtained by adding an adapter header, an auxiliary panel, and the main bearing member in different positions.

The multiple oriented insertion slots, formed in the edge of the main support members, allow a user to adjust and change the angle of the support base, foot member, and main bearing member. The stability of the piece of furniture is achieved by augmenting the support provided by the at least one foot member with the support provided by the lower main support member through alignment so that the foot member and the lower main support member functionally supplement each other. Built-in or added channels formed in and/or on the sides and upper edges of the main support members—or in some of their parts—may be provided to accommodate cables of apparatuses such as lamps, cords, etc.

Each of the main support members and cantilevered members are sized to be easily packed into small containers, particularly a briefcase, and do not exceed a predetermined length. In this way, the modular assembly kit can be easily transported and the piece of furniture can be readily assembled or disassembled at any location.

BRIEF DESCRIPTION OF THE DRAWINGS

The foregoing summary, as well as the following detailed description of the preferred embodiments, will be better understood when read in conjunction with the appended drawings. For the purpose of illustrating the invention, there is shown in the drawings the embodiments that are presently preferred. It should be understood, however, that the invention is not limited to the precise arrangements shown.

FIG. 1 is a side view of a main support member with oriented insertion slots comprising a lower support member, an intermediate support member, and an upper support member;

FIG. 1*a* is a detailed view of different foot members shown in FIG. 1*c;*

FIG. 1*b* is a detailed view of a clamping means for keeping aligned the main support members;

FIG. 8 illustrates a bearing member;

FIGS. 9*a*-9*f* illustrate cantilevered members with open insertion slots;

FIG. 10 is a detailed view of a back-up;

DETAILED DESCRIPTION OF THE PREFERRED EMBODIMENTS

Figure 2:
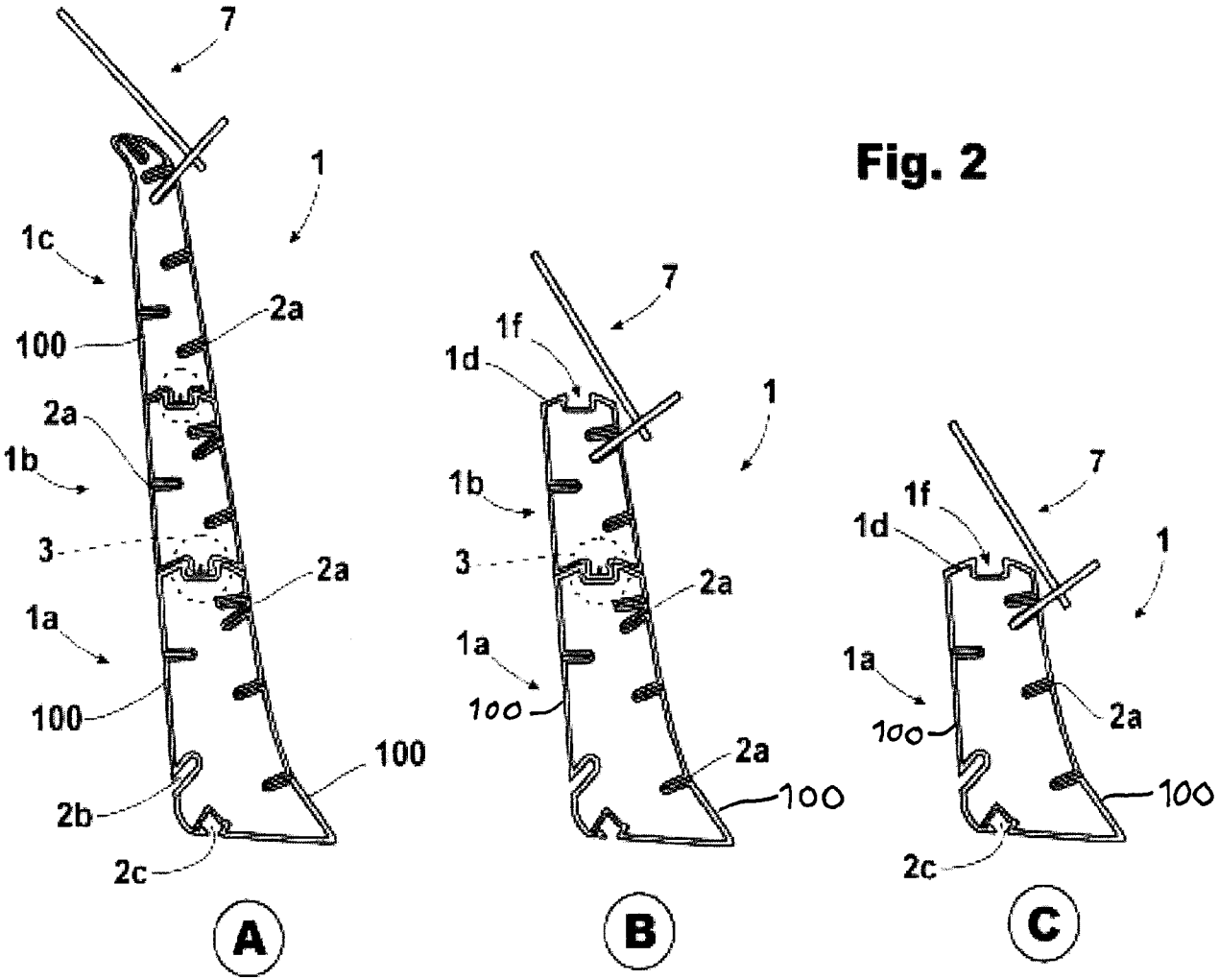
FIG. 2*a* illustrates a main support member with oriented insertion slots comprising a lower support member, an intermediate support member, an upper support member, and a bearing member that is disposed in an upper portion of the upper support member.
FIG. 2*b* illustrates a main support member with oriented insertion slots comprising a lower support member, an intermediate support member, and a bearing member that is disposed in an upper portion of the intermediate support member.
FIG. 2*c* illustrates a main support member with oriented insertion slots comprising a lower support member and a bearing member that is disposed in an upper portion of the lower support member.
Figure 3:
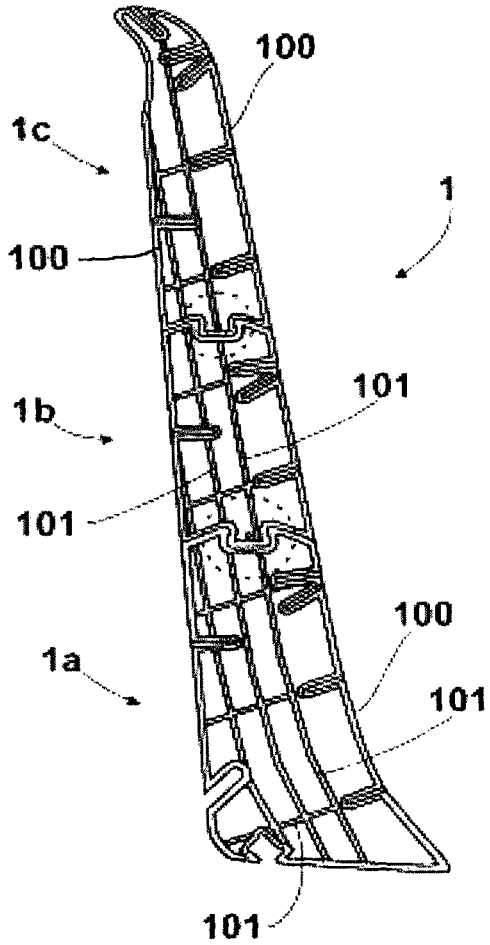
FIG. 3 illustrates a coupling of a main support member comprising a lower support member, an intermediate support member, and an upper support member.

Certain terminology is used in the following description for convenience only and is not limiting. The words "front," "back," "forward," "backwards," "inner," and "outer" designate directions in the drawings to which reference is made. Additionally, the terms "a" and "one" are defined as including one or more of the referenced item unless specifically noted otherwise. A reference to a list of items that are cited as "at least one of a, b, or c" (where a, b, and c represent the items being listed) means any single one of the items a, b, or c, or combinations thereof. The terminology includes the words specifically noted above, derivations thereof, and words of similar import.

FIG. 1 shows a side view of the main support members 1, once assembled, consisting of a lower main support member 1*a*, an intermediate support member 1*b* and an upper main support member 1*c*.

The lower main support member 1*a* comprises a set of foot slots 2*b*, 2*c* that are each suitable for receiving at least one first foot member 4*a*, 4*b*, as shown in FIG. 1*a*. The first foot member 4*a* has an insertion slot 4*e* capable of being inserted into the first foot slot 2*b*, while the second foot member 4*b* has an insertion slot 4*f* capable of being inserted into the second foot slot 2*c*.

The first and second foot slots 2*b*, 2*c* have an arrangement and depth formed such that both the first and second foot members 4*a*, 4*b* can be inserted therein and be mutually engaged by a protruding end(s) 4*d* of the second foot member 4*b* by inserting the protruding end 4*d* into slots 4*c* of the first foot member 4*a* After the first and second foot members 4*a*, 4*b* have been coupled with the first and second foot slots 2*b*, 2*c*, the already coupled members 4*a*, 4*b* must be moved together until respective locking ends 1*f* of the first and second foot members 4*a*, 4*b* and the first and second foot slots 2*b*, 2*c* intersect. The coupled members 2*b*, 2*c*, 4*a*, 4*b* are locked together at the point where they intersect. The first and second foot members 4*a*, 4*b* are disengaged from the first and second foot slots 2*b*, 2*c* by withdrawing these members 2*b*, 2*c*, 4*a*, 4*b* from their corresponding locking ends 2*bf*, 2*cf*, as shown in FIGS. 1*a*, 2*b* and 2*c*.

In addition, the lower support member 1*a*, intermediate support member 1*b*, and upper support member 1*c* each have oriented insertion slots 2*a*. In one embodiment described herein, the oriented insertion slots 2*a* are shallow and located on both sides of the main support members 1*a*, 1*b*, 1*c*. The oriented insertion slots 2*a* act as grooves, have a certain depth, and are configured to receive other members. The main support members 1*a*, 1*b*, 1*c* may have multiple-engagement slots and/or branches that are oriented at different angles, such that multiple members may be inserted into the multiple-engagement slots 2*a* at a desired angle.

In another embodiment, the oriented insertion slots 2*a* may pass through the walls of the main support members 1*a*, 1*b*, 1*c*.

As shown in FIGS. 1, 2*a*-2*c*, 3, 6*a*, and 6*b*, the structural strength of the main support members 1*a*, 1*b*, 1*c* is achieved by inclusion of outer structural reinforcement means 100, inner structural reinforcement means 101, and engagement reinforcement means 200.

Figure 4:
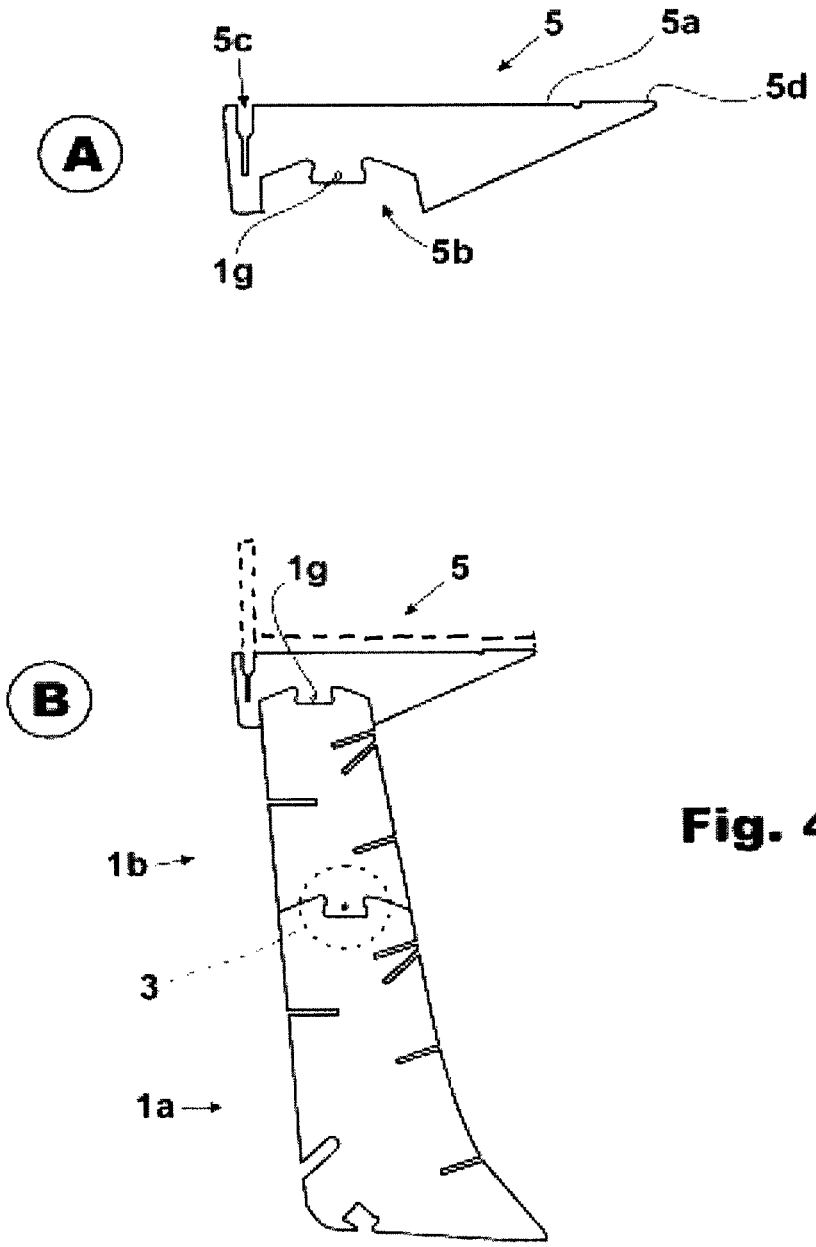
FIGS. 4*a* and 4*b* illustrate the elements of FIG. 2*b* configured as a table.

The above mentioned main support members 1*a*, 1*b*, 1*c* are engaged to each other to erect a piece of furniture. Specifically, when the main support members 1*a*, 1*b*, 1*c* are to be coupled, the engagement is performed by means of coupling members 1*f*, as shown in FIGS. 2*a*-2*c* and 5. As shown in FIGS. 1*b* and 4, the coupling members 1*f* may be of the dovetail type, among others, and include fastening openings 1*g*. The fastening openings 1*g* allow for the passage of securing clamps 3 therethrough. The securing clamps 3 have a set of flat jaws 3*a*, 3*b* fitted with a stud 3*c* and a threaded portion 3*d*. The threaded portion passes through the fastening opening 1*g* and allows for engagement of the securing clamp to both coupling members 1*f*. For assembly of the main support members 1*a*, 1*b*, 1*c*, the securing clamps 3 are arranged to secure the area adjacent to the coupling members 1*f* and to keep at least two of the main support members 1*a*, 1*b*, 1*c* aligned, as shown in FIGS. 1*b*, 2*a*-2*c*, 4, 13, and 15. In FIGS. 7-9*f* and 11*a*-11*g*, cantilevered members 300, 6, 8, 9, 11, 15, 16, 17 are shown. The cantilevered members 300, 6, 8, 9, 11, 15, 16, 17 can be made of a single plastic or a plastic combined with a second material selected from the group comprising wood fibers, glass fibers or carbon fibers. In one embodiment, the second material comprises at least 20% and no more than 40% of the total material of which the cantilevered members 300, 6, 8, 9, 11, 15, 16, 17 are made. The oriented insertion slots 2*a* are formed so that the open insertion slots 300*a*, 6*a*, 8*a*, 9*a*, 11*a*, 12*a*, 15*a*, 16*a* of the cantilevered members 300, 6, 8, 9, 11, 12, 15, 16 can be slidingly received by the oriented insertion slots 2*a*.

In one embodiment, shown in FIGS. 7, 8, 9*a*-9*f*, and 11*a*-11*g*, the open insertion slot 300*a* of the cantilevered member 300 has a front fit-in section 301 and a rear insertion section 302. The front fit-in section can be inserted in an insertion stop 303. This structure also applies to the open insertion slots 6*a*, 8*a*, 9*a*, 11*a*, 12*a*, 15*a*, 16*a*, 17*a*.

In another embodiment, shown in FIGS. 2*a*-2*c*, 8, 9*a*-9*f* and 13, the present assembly has a main bearing member 7 that can be used in a variety of ways, depending on the configuration chosen. For example, to obtain a lectern configuration, the bearing member 7 engages a cantilevered member 300, 6, 8, 9, 11, 12, 15, 16 that operates as a support base 8, shown in FIGS. 8*c*, 8*d*, 10. The support base 8 has a mounting slot 8*a* for insertion into any one of the oriented insertion slots 2*a* located in the main support members 1*a*, 1*b*, 1*c*. The support base 8 also has a female insertion slot 8*b* that receives a male insertion member 7*a* of the main bearing member 7.

The main bearing member 7 has a flat surface 7*b* that is sized to support miscellaneous objects.

In addition, the support base 8 has a front surface 8*d* positioned between a front edge of the support base 8 and the female insertion slot 8*b*, as shown in FIG. 9*a*. The front surface 8*d* can also include a recess 8*c* that is configured to receive necks of instruments, as shown in FIG. 9*b*.

Figure 5:
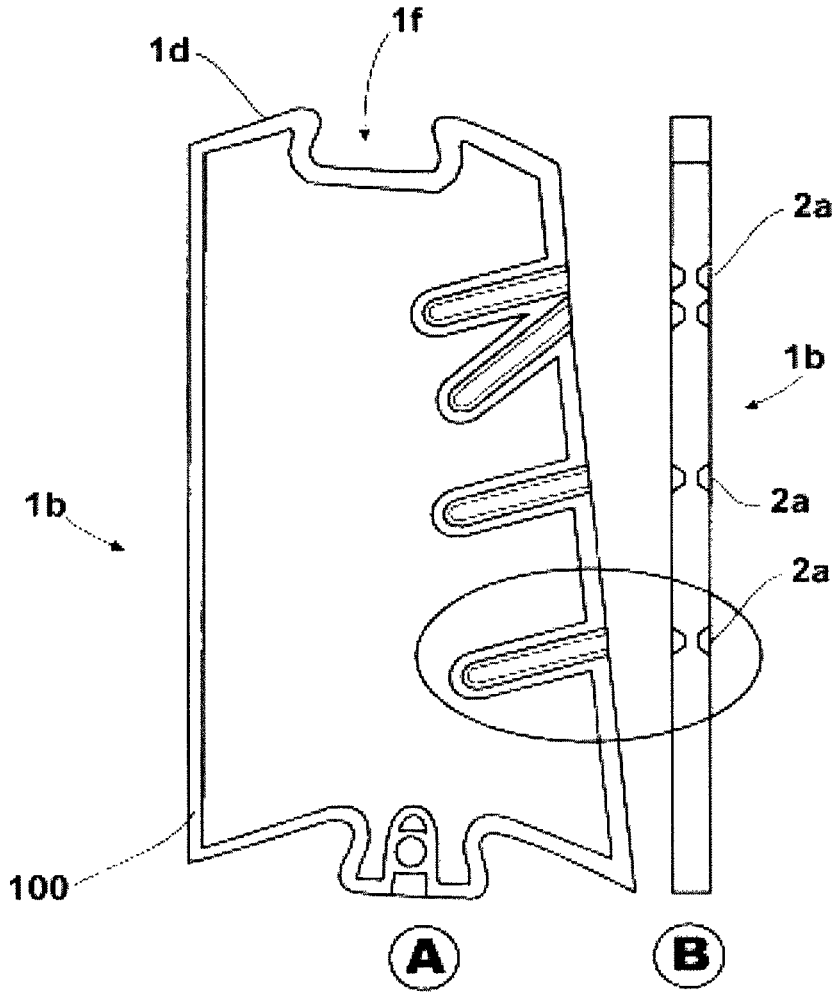
FIGS. 5*a* and 5*b* illustrate, respectively, a front view and a side view of one of the main support members with oriented insertion slots.
Figure 6:
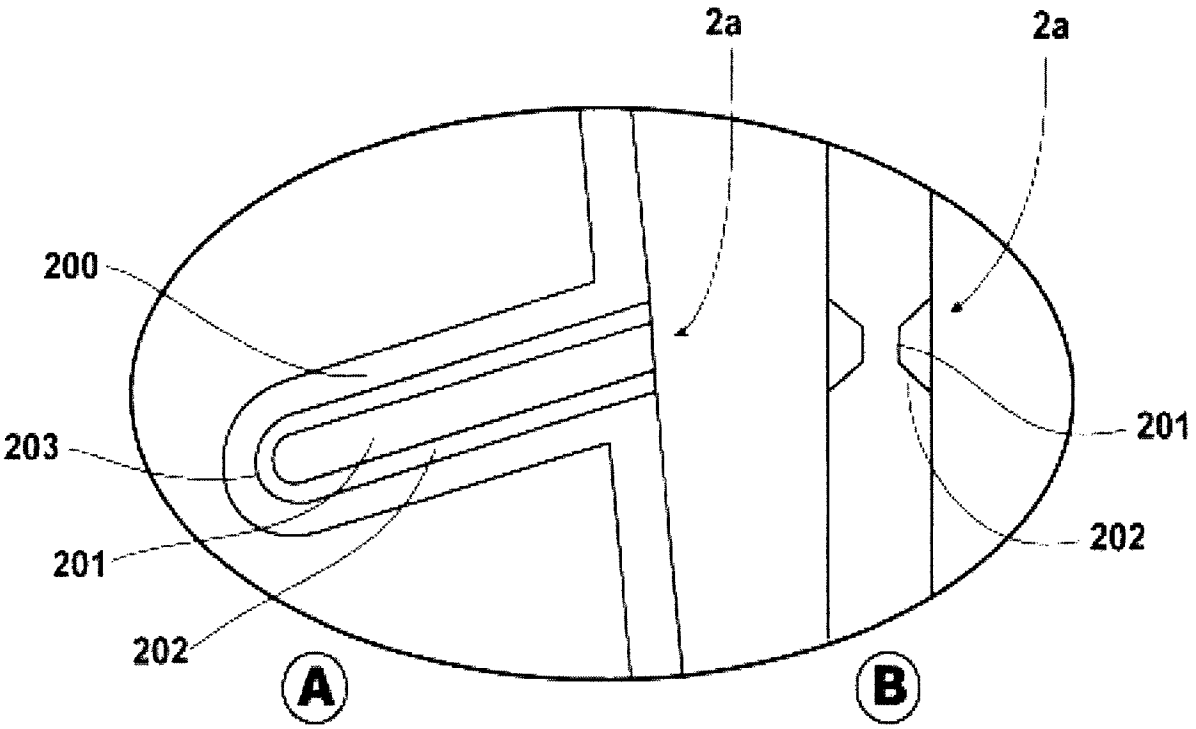
FIGS. 6*a* and 6*b* illustrate a detailed view of the oriented insertion slots of one of the main support members.
Figure 7:
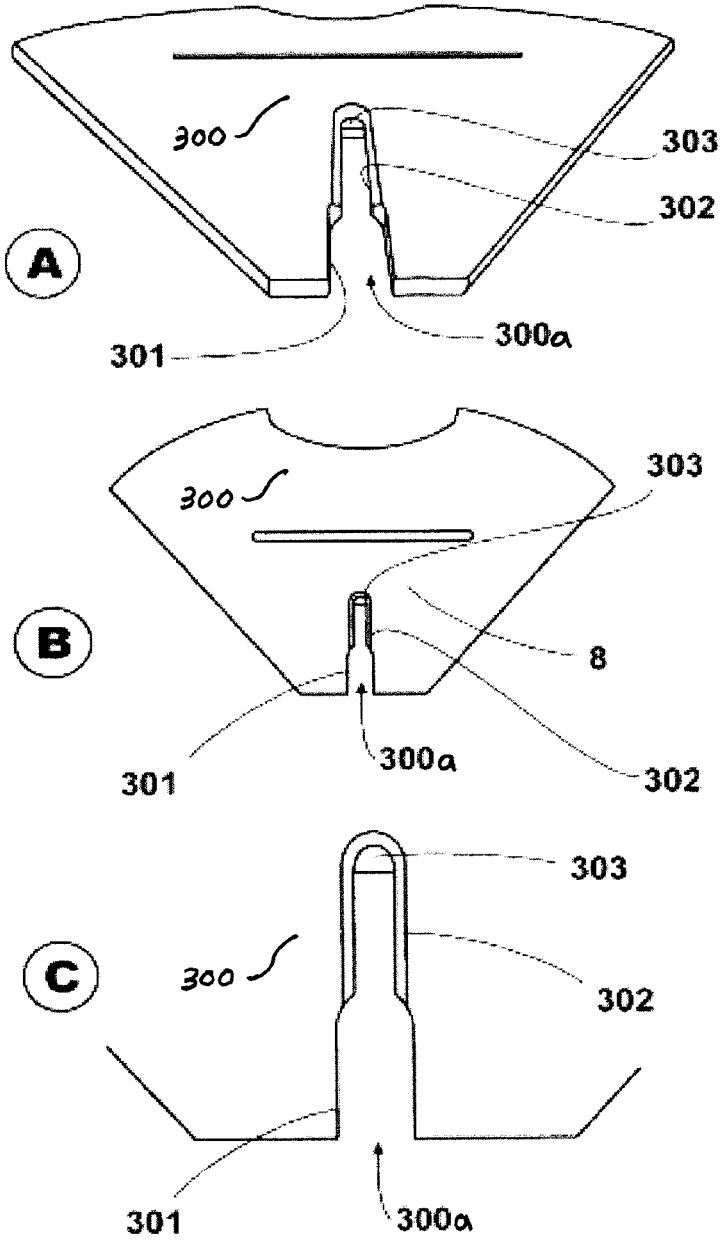
FIGS. 7*a*-7*c* illustrate cantilevered members with open insertion slots.

As shown in FIGS. 4*a*, 4*b* and 5, an adapting header 5 is used to assemble the components of the kit as a table. A mounting opening 5*b* formed in an upper end 1*d* of the intermediate support member 1*b* is configured to receive the adapting header 5, as shown in FIGS. 2*a*-2*c*, 5*a*, and 5*b*. The adapting header 5 has a support edge 5*a*, a rear slot 5*c*, and a support end 5*d*. The main bearing member 7 is supported by the support edge 5 while the rear slot 5*c* is configured such that a cantilevered member that acts as an auxiliary panel 6 may be inserted therein, as shown in FIGS. 4 and 9*a*. The mounting structure of the main bearing member 7 is thus retained in a horizontal position for use as a table. The obtained assembly is secured by the support end 5*d*, which fits into a utility recess 7*c* of the main bearing member 7, thus preventing the relative displacement of the adapting header 5 and the main bearing member 7 that are interlocked.

Figure 11:
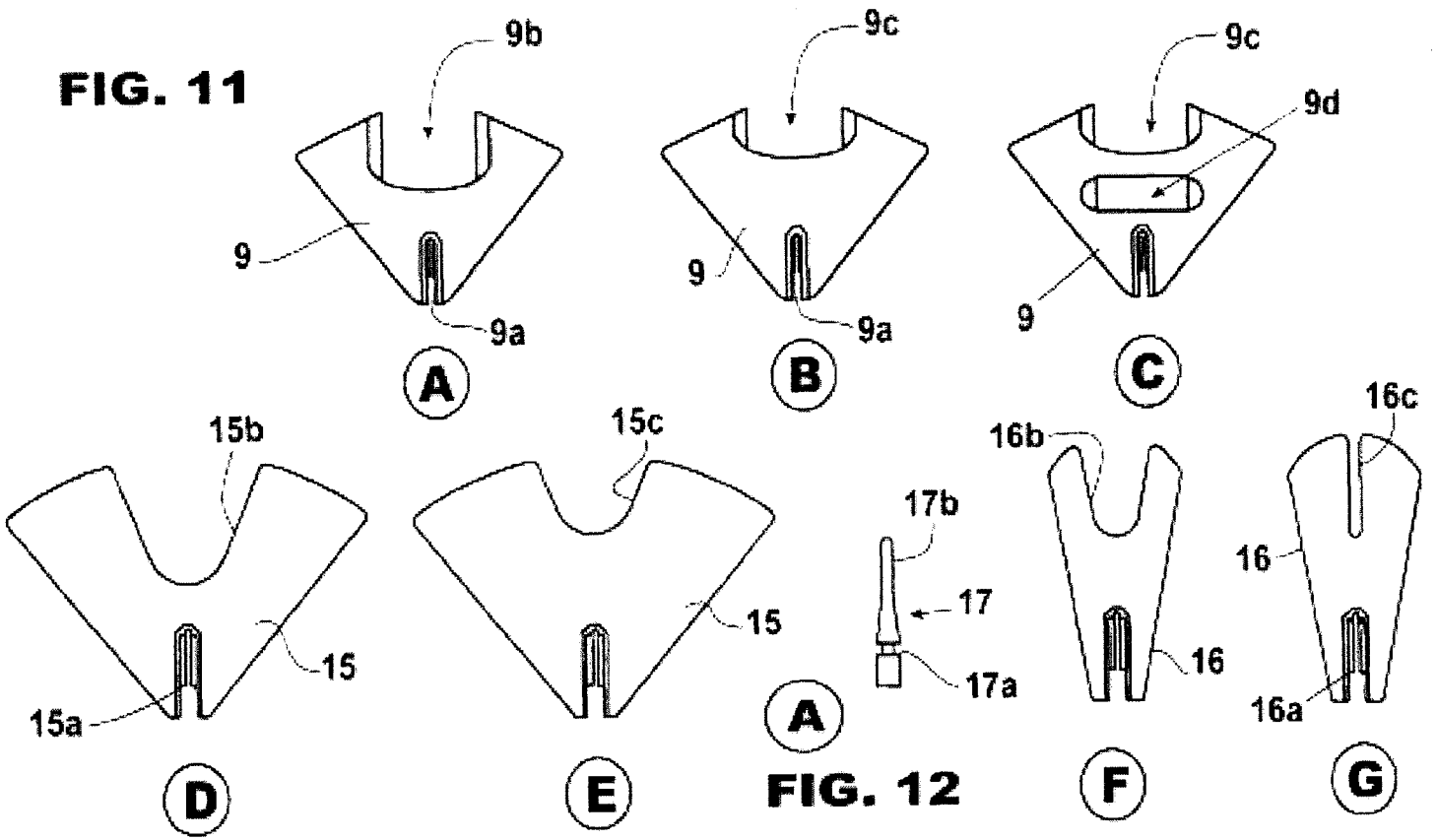
FIGS. 11*a*-11*g* illustrate cantilevered members with open insertion slots.
Figure 15:
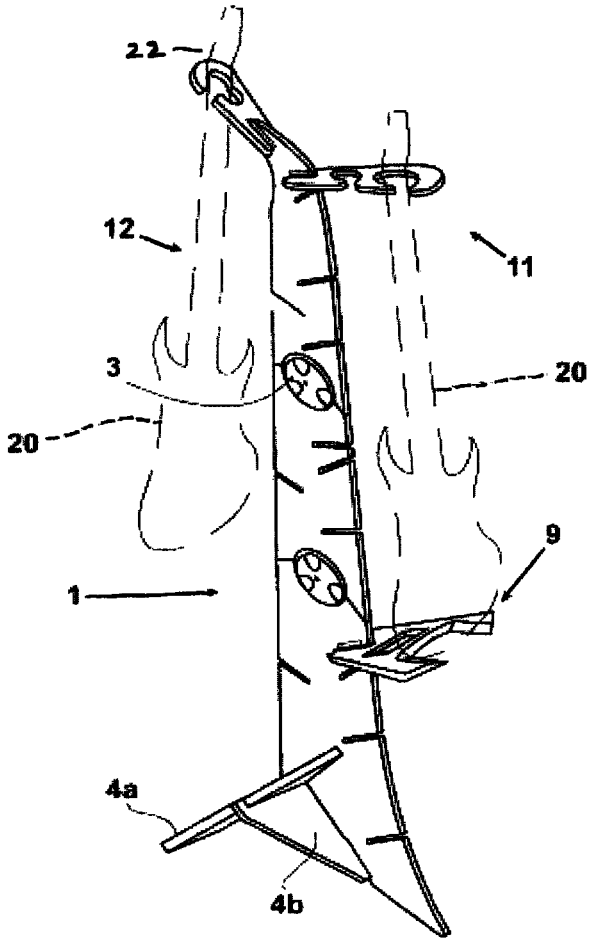
FIG. 15 illustrates the stand of the invention with cantilevered members acting as supports for a box or body of a guitar or as a support for a base of another musical instruments.

As shown in FIGS. 8*d* and 8*e*, the present assembly may include various other cantilevered members such as a cantilevered member that acts as an upper support member 11 that can be inserted into any of the oriented insertion slots 2*a*. The upper support members 11 can comprise one or more inlet openings 11*b*, 11*c* into which the neck 22 of a guitar 20 or the body of wind instruments, for example, can be received, as shown in FIG. 15. The upper support members 11 augment the cantilevered members which act as lower support members 9 which, in different embodiments, can comprise one or more large or small insertion openings 9*b*, 9*c*, 9*d*, as shown in FIGS. 11*a*-11*c*. The large and small insertion openings 9*b*, 9*c*, 9*d* are configured to support boxes or bodies 21 of guitars or bases of other musical instruments, as shown in FIGS. 11*a*-11*c* and 15.

The auxiliary panel 6 may be used in combination with a backup member 14 that includes protrusions 14*a* to be inserted into slots 6*b* formed in the auxiliary panel 6. This assembly can then be inserted into any of the oriented insertion slots 2*a*, and acts as a shelf for small accessories such as metronomes.

In one embodiment, shown in FIGS. 9*a* and 10, an auxiliary panel 6 works in combination with a backup member 14 that has protrusions 14*a*. The protrusions 14*a* are inserted into slots 6*b* formed in the auxiliary panel 6. This assembly can be inserted into any one of the oriented insertion slots 2*a* to form a shelf for small accessories such as metronomes.

In another embodiment, shown in FIGS. 11*d*, 11*e*, 11*g*, and 11*h*, cantilevered members can act as saxophone holding members 15 or as wind instrument-holding members 16.

Figure 12:
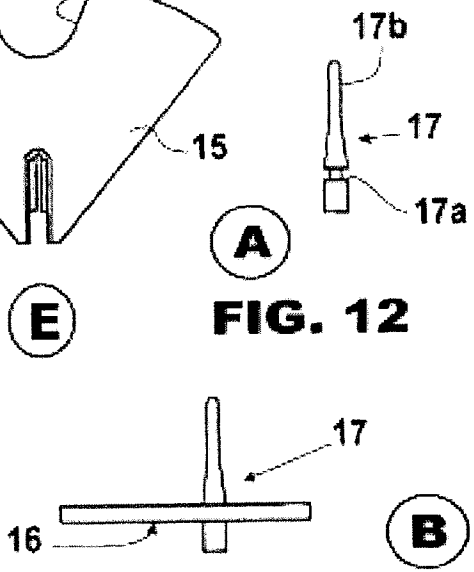
FIGS. 12*a* and 12*b* are detailed views of a spindle that works in combination with the cantilevered members of FIGS. 11*f* and 11*g;*
Figure 13:
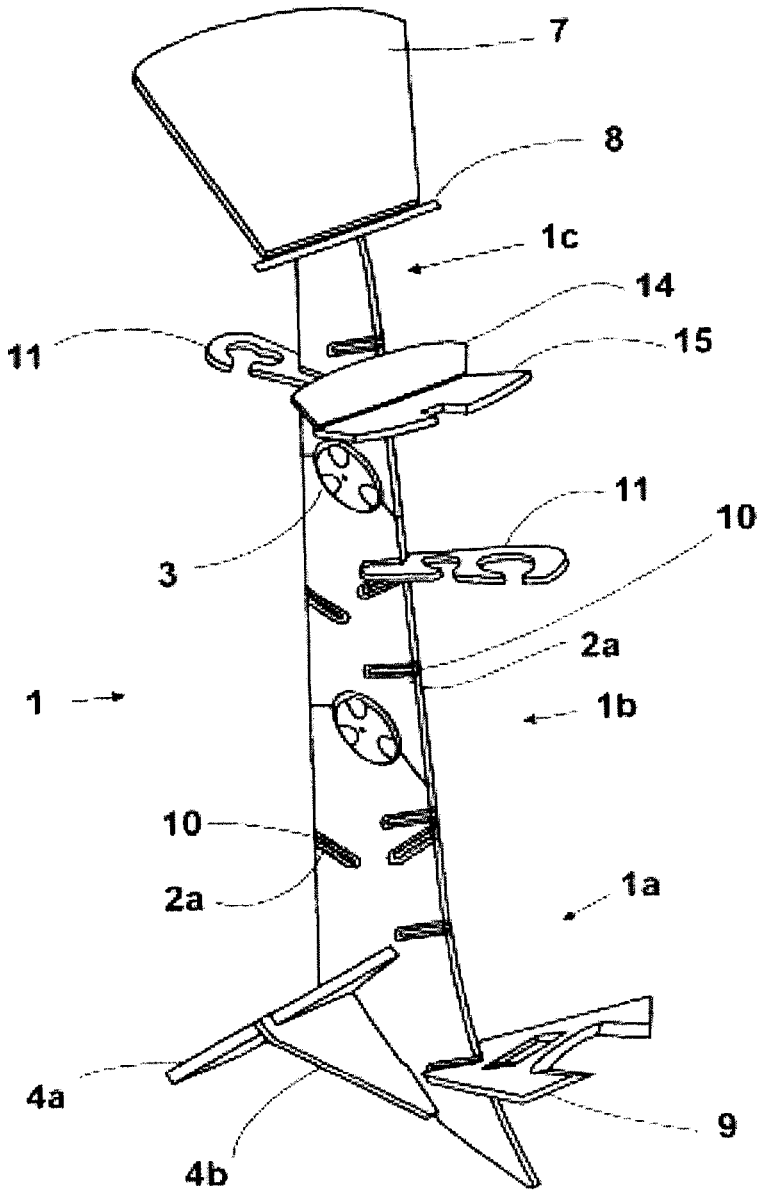
FIG. 13 illustrates the stand of the invention fully assembled.

In the above embodiment, the cantilevered members come in pairs and include mouting slots 15*a*, 16*a* that are used to mount the cantilevered members on any one of the oriented insertion slots 2*a* formed in any one of the main support members 1*a*, 1*b*, 1*c*. At least one of the saxophone-holding members 15 is mounted in the upper portion of the assembly and comprises an upper support opening 15*b*. The other saxophone-holding member 15 is mounted in the lower portion of the assembly and comprises a lower support opening 15*c*. Similarly, at least one of the wind instrument holding members 16 comprises an upper opening 16*b*, which is mounted in the upper portion of the assembly. The other wind instrument-holding member includes a slot 16*c* and is mounted in the lower portion of the assembly, into which fits a spindle, as shown in FIGS. 12*a* and 12*b*.

Figure 14:
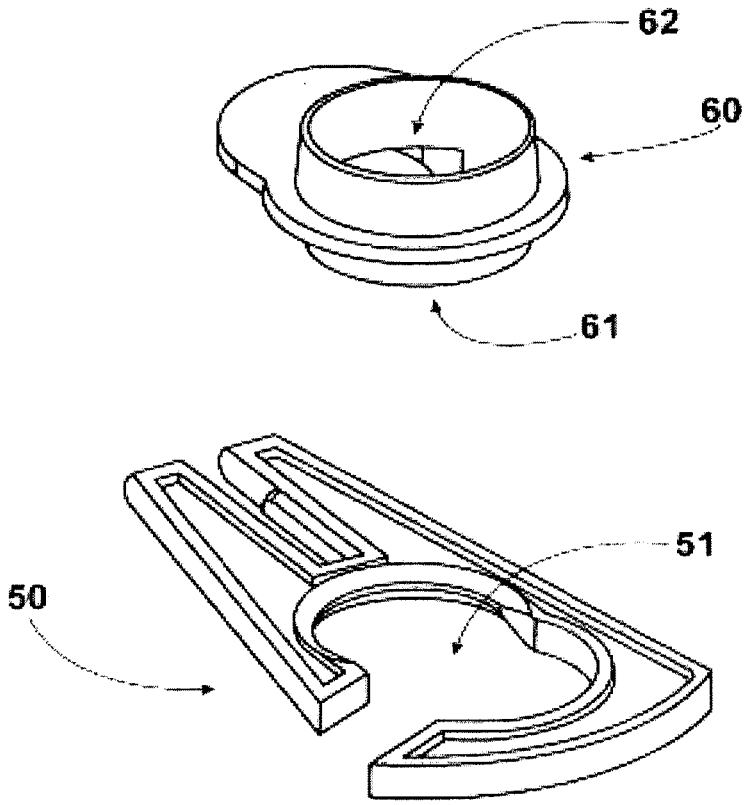
FIG. 14 is a detailed view of a glass support comprising a glass fitting and locking opening and a can support with a corresponding can fitting and locking opening.

In one embodiment, shown in FIG. 14, cantilevered members can be used as a glass support 50. The cantilevered members comprise a glass fitting and locking opening 51 and a can support 60. The can support 60 has a corresponding can fitting and locking opening 61. Both the glass support 50 and the can support 60 augment each other and work in a supplementary fashion.

Figure 16:
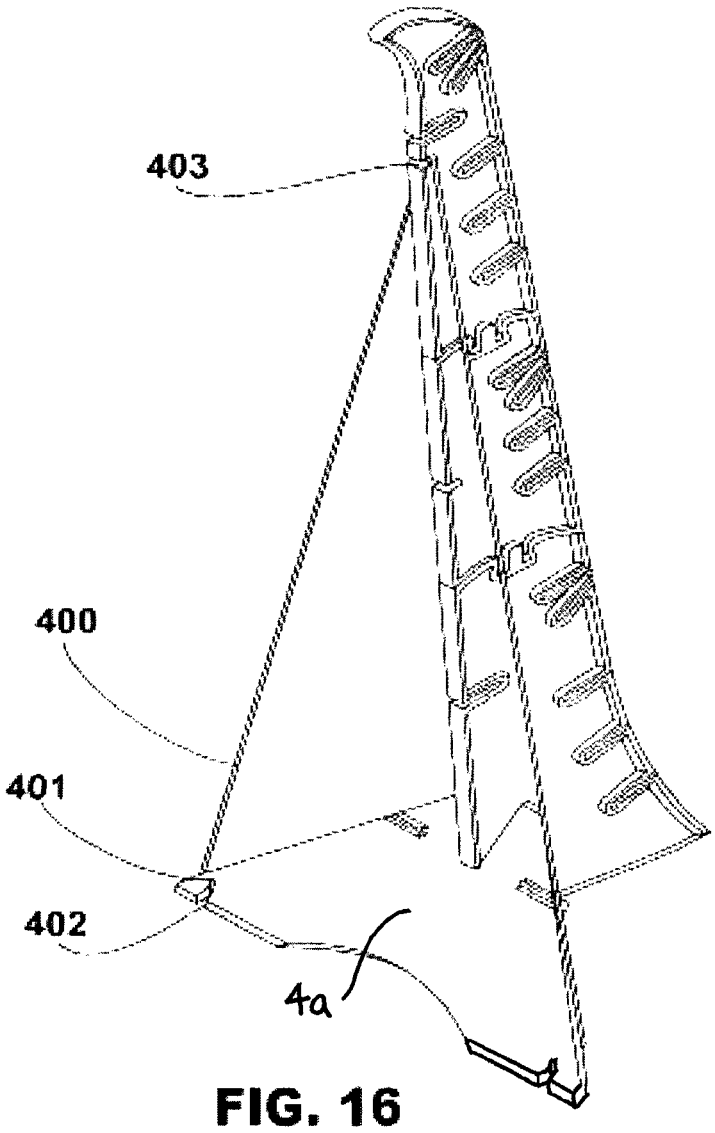
FIG. 16 illustrates a thread-like fastening means that has a male fastener configured to secure the upper main support member with the foot member.

In another embodiment, shown in FIG. 16, where enhanced stability is required, a thread-like fastening means 400 with fasteners 401 is provided. The fasteners 401 secure the upper portion of the assembly to the lower portion of the assembly through a set of openings 402, 403 located in the first and second foot members 4*a*, 4*b* and in the rear portion of at least one of the main support members 1*a*, 1*b*, 1*c*.

Having thus described various methods, configurations, and features of the present kit for modular assembly of a piece of furniture "in situ" in detail, it is to be appreciated and will be apparent to those skilled in the art that many configurations, only a few of which are exemplified in the detailed description above, could be made in the apparatus and method without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

The invention claimed is:

1. A kit for modular assembly of a piece of furniture "in situ" comprising:

a main support member;

a plurality of cantilevered members; and, at least one foot member;

the main support member having a plurality of first insertion slots with chamfered edges, each of the plurality of first insertion slots being oriented at an angle and configured to slidingly engage a second insertion slot with chamfered edges that is formed in at least one of the plurality of cantilevered members, the second insertion slot having a front fit-in section and a rear insertion section that ends in an insertion stop, the at least one foot member having at least one third insertion slot with chamfered edges that is configured to slidingly engage at least one fourth insertion slot with chamfered edges that is formed in at least one first foot slot, a front section of the at least one first foot slot is oriented to engage a locking end of the at least one foot member, and the main support member having first and second coupling members that comprise respective fastening openings that are each configured to receive a fastening clamp that aligns and secures the main support member to a respective one of the plurality of cantilevered members or to the at least one foot member.

2. The kit according to claim 1, wherein the fastening clamp has first and second jaw members, a stud, and a threaded portion that engages and is secured in the respective fastening openings of the first and second coupling members.

3. The kit according to claim 1, wherein the coupling members are of the dovetail-type.

4. The kit according to claim 1, wherein the first, second, third, and fourth insertion slots further comprise structural reinforcement elements and engagement reinforcement elements that are provided about the respective chamfered edges of the respective first, second, third, and fourth insertion slots.

5. The kit according to claim 1, wherein the edges of the main support member form handle openings for insertion or extraction of the securing clamps.

6. The kit according to claim 1, wherein at least one of the plurality of cantilevered members is configured to support a glass.

7. The kit according to claim 1, wherein the plurality of cantilevered members further comprise at least one support panel and at least one back-up member, the back-up member having at least one protrusion configured to be inserted into a slot formed in the at least one support panel, and the at least one support panel being configured to be inserted into at least one of the plurality of first insertion slots of the main support member.

8. The kit according to claim 1, wherein at least one of the plurality of cantilevered members includes a mounting slot that is inserted in at least one of the plurality of first insertion slots of the main support member, the at least one cantilevered member having an upper portion with an upper support opening and a lower portion with a lower support opening, the upper and lower support openings being configured to hold a saxophone.

9. The kit according to claim 1, wherein at least one of the plurality of cantilevered members has an upper opening that is mounted to an upper portion of the main support member and a slot formed in a lower portion of the cantilevered member that receives a spindle, the upper opening and the slot being configured to receive a wind instrument.

10. The kit according to claim 1, wherein at least one of the plurality of cantilevered members has a glass fitting and a locking opening that are configured to support a glass.

11. The kit according to claim 1, wherein the first and second coupling members each comprise a threaded fastener that is configured to engage an upper portion of the main support member with a lower portion of the main support member through a set of openings formed in the at least one foot member and a rear portion of the main support member.

12. The kit according to claim 1, wherein the main support member further comprises at least one lower support member, at least one intermediate support member, and at least one upper support member, each of the lower, intermediate, and upper support members having respective outer structural reinforcement elements, inner structural reinforcement elements, and engagement reinforcement elements that are provided about a respective edge or body of the respective lower, intermediate, and upper support members.

13. The kit according to claim 12, wherein the at least one upper support member has at least one opening that receives at least a portion of a musical instrument.

14. The kit according to claim 12, wherein at least one of the plurality of cantilevered members includes at least one upper support member that has at least one inlet opening that is configured to receive the neck of a guitar or the body of a wind instrument and at least one lower support member that has at least one large or small insertion opening that supports a box or body of a guitar or a base of another musical instrument.

15. The kit according to claim 1, wherein each of the plurality of cantilevered members are made of a single plastic or a plastic combined with a second material selected from a group comprising of wood fibers, glass fibers, or carbon fibers.

16. The kit according to claim 15, wherein the second material comprises no less than 20% and no greater than 40% of the total material of which the plurality of cantilevered members are made.

17. The kit according to claim 12, further comprising a main bearing member that has a male insertion slot that is configured to engage a female insertion slot formed in at least one support base, the at least one support base having a mounting slot for insertion into at least one of the plurality of first insertion slots provided in the main support member for erection of a lectern.

18. The kit according to claim 17, wherein the main bearing member is formed as a flat surface and extends outwards in a horizontal direction to support miscellaneous objects and the at least one support base has a front surface that is positioned between a front edge of the front surface and the female insertion slot.

19. The kit according to claim 17, further comprising an adapting header having a mounting opening configured for engagement with the at least one intermediate support member, the adapting header having at least one support edge that is configured to support the main bearing member, at least one rear slot that receives an auxiliary panel, and at least one support end for erection of a table.

20. The kit according to claim 19, wherein the main bearing member extends outwards in a horizontal direction and is interlocked with the adapting header, the at least one support end being inserted into a utility recess to prevent relative displacement of the main bearing member relative to the adapting header.

* * * * *